US006267472B1

(12) United States Patent
Maher et al.

(10) Patent No.: US 6,267,472 B1
(45) Date of Patent: Jul. 31, 2001

(54) INK JET HEATER CHIP MODULE WITH SEALANT MATERIAL

(75) Inventors: Colin Geoffrey Maher; Ashok Murthy; Darrin Wayne Oliver; Robert Allen Samples; Jeanne Marie Saldanha Singh, all of Lexington; Carl Edmond Sullivan, Versailles, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/100,070

(22) Filed: Jun. 19, 1998

(51) Int. Cl.[7] ..... B41J 2/05

(52) U.S. Cl. ..... 347/65; 347/63; 347/58; 347/59

(58) Field of Search ..... 347/65, 63, 85, 347/20, 58, 59, 50

(56) References Cited

U.S. PATENT DOCUMENTS

| | | | | |
|---|---|---|---|---|
| 4,500,895 | * | 2/1985 | Buck | 347/87 |
| 4,635,073 | * | 1/1987 | Hanson | 346/1.1 |
| 4,678,529 | * | 7/1987 | Drake et al. | 347/63 |
| 4,695,854 | | 9/1987 | Cruz-Uribe . | |
| 4,712,172 | * | 12/1987 | Kiyohara | 347/87 X |
| 4,812,859 | * | 3/1989 | Chan | 347/63 |
| 4,881,318 | * | 11/1989 | Komuro et al. | 29/827 |
| 4,942,408 | * | 7/1990 | Braun | 346/140 |
| 5,036,337 | | 7/1991 | Rezanka . | |
| 5,095,321 | * | 3/1992 | Saito et al. | 347/63 |
| 5,192,959 | * | 3/1993 | Drake et al. | 346/140 |
| 5,332,386 | * | 8/1995 | Childers et al. | 347/63 |
| 5,333,007 | | 7/1994 | Kneezel et al. . | |
| 5,420,627 | * | 3/1995 | Keefe et al. | 347/58 |
| 5,450,113 | | 9/1995 | Childers et al. . | |
| 5,469,199 | | 11/1995 | Allen et al. . | |
| 5,563,643 | | 10/1996 | Carlotta et al. . | |
| 5,581,288 | | 12/1996 | Shimizu et al. . | |
| 5,635,965 | | 6/1997 | Purwins et al. . | |
| 5,696,544 | * | 12/1997 | Komuro | 347/58 |
| 5,963,232 | * | 10/1999 | Kasamoto et al. | 347/59 |

FOREIGN PATENT DOCUMENTS

| | | | |
|---|---|---|---|
| 0 822 078 A2 | 2/1998 | (EP) | B41J/2/14 |
| 0 822 080 A2 | 2/1998 | (EP) | B41J/2/14 |

* cited by examiner

*Primary Examiner*—John Barlow
*Assistant Examiner*—Manish Shah
(74) *Attorney, Agent, or Firm*—Robert L. Showalter

(57) ABSTRACT

A heater chip module is provided comprising a carrier adapted to be secured directly to an ink-filled container, at least one heater chip having a base coupled to the carrier, and at least one nozzle plate coupled to the heater chip. The carrier includes inner side walls and a support section which together define an inner cavity. An edge feed heater chip is coupled to the carrier support section. The heater chip includes side walls. The support section includes first and second passages which define first and second paths for ink to travel from the container to the inner cavity. The inner cavity and the heater chip are sized such that a first side wall of the heater chip is spaced from a first inner side wall of the carrier and a second side wall of the heater chip is spaced from a second inner side wall of the carrier. A nozzle plate is coupled to the heater chip and the carrier. The nozzle plate has a width such that the nozzle plate extends over an outer surface of the carrier. Sealant material is provided in the inner cavity such that at least a portion of the first inner side wall of the carrier, at least a portion of the first side wall of the heater chip, a first section of the nozzle plate and the sealant material define a first sealed ink cavity for receiving ink passing through the first passage. Additional sealant material is provided in the inner cavity such that at least a portion of the second inner side wall of the carrier, at least a portion of the second side wall of the heater chip, a second section of the nozzle plate and the additional sealant material define a second sealed ink cavity for receiving ink passing through the second passage.

30 Claims, 6 Drawing Sheets

INK JET HEATER CHIP MODULE WITH SEALANT MATERIAL

CROSS-REFERENCE TO RELATED APPLICATIONS

This application is related to contemporaneously filed Patent Applications U.S. Ser. No. 09/100,544, entitled "AN Ink JET HEATER CHIP MODULE," U.S. Ser. No. 09/100,485, entitled "A Heater CHIP MODULE AND PROCESS FOR MAKING SAME," U.S. Ser. No. 09/099,854, entitled "A Process FOR MAKING A HEATER CHIP MODULE," U.S. Ser. No. 09/100,538, entitled "A Heater CHIP MODULE FOR USE IN AN INK JET PRINTER," and U.S. Ser. No. 09/100,218, entitled "AN INK Jet HEATER CHIP MODULE INCLUDING A NOZZLE PLATE COUPLING A HEATER CHIP TO A CARRIER," the disclosures of which are incorporated herein by reference.

FIELD OF THE INVENTION

This invention relates to an ink jet heater chip module adapted to be secured to an ink-filled container.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's printhead. The printhead typically comprises the heater chip and a nozzle plate having a plurality of the discharge nozzles formed therein. The printhead forms part of an ink jet print cartridge which also comprises an ink-filled container.

A plurality of dots comprising a swath of printed data are printed as the ink jet print cartridge makes a single scan across a print medium, such as a sheet of paper. The data swath has a given length and width. The length of the data swath, which extends transversely to the scan direction, is determined by the size of the heater chip.

Printer manufacturers are constantly searching for techniques which may be used to improve printing speed. One possible solution involves using larger heater chips. Larger heater chips, however, are costly to manufacture. Heater chips are typically formed on a silicon wafer having a generally circular shape. As the normally rectangular heater chips get larger, less of the silicon wafer can be utilized in making heater chips. Further, as heater chip size increases, the likelihood that a chip will have a defective heating element, conductor or other element formed thereon also increases. Thus, manufacturing yields decrease as heater chip size increases.

Accordingly, there is a need for an improved printhead or printhead assembly which allows for increased printing speed yet is capable of being manufactured in an economical manner.

SUMMARY OF THE INVENTION

In accordance with the present invention, a heater chip module is provided comprising a carrier adapted to be secured directly to an ink-filled container, at least one heater chip having a base coupled to the carrier, and at least one nozzle plate coupled to the heater chip. The carrier includes inner side walls and a support section which together define an inner cavity. An edge feed heater chip is coupled to the carrier support section. The heater chip includes side walls. The support section includes first and second passages which define first and second paths for ink to travel from the container to the inner cavity. The inner cavity and the heater chip are sized such that a first side wall of the heater chip is spaced from a first inner side wall of the carrier and a second side wall of the heater chip is spaced from a second inner side wall of the carrier. A nozzle plate is coupled to the heater chip and the carrier. The nozzle plate has a width such that the nozzle plate extends over an outer surface of the carrier. Sealant material is provided in the inner cavity such that at least a portion of the first inner side wall of the carrier, at least a portion of the first side wall of the heater chip, a first section of the nozzle plate and the sealant material define a first sealed ink cavity for receiving ink passing through the first passage. Additional sealant material is provided in the inner cavity such that at least a portion of the second inner side wall of the carrier, at least a portion of the second side wall of the heater chip, a second section of the nozzle plate and the additional sealant material define a second sealed ink cavity for receiving ink passing through the second passage.

A flexible circuit is coupled to the heater chip such as by wire bonding or TAB bonding.

Two or more heater chips, positioned end to end or offset from one another, may be secured to a single carrier. Thus, two or more smaller heater chips can be combined to create the effect of a single, larger heater chip. That is, two or more smaller heater chips can create a data swath that is essentially equivalent to one printed by a substantially larger heater chip.

Each of two or more heater chips coupled to a single carrier may be dedicated to a different color. For example, three heater chips positioned side by side may be coupled to a single carrier, wherein each heater chip receives ink of one of the three primary colors.

The inner cavity has a first length, the heater chip has a second length and the nozzle plate has a third length. Preferably, the third length of the nozzle plate is less than the first length of the inner cavity. More preferably, the third length of the nozzle plate is approximately equal to or less than the second length of the heater chip. If the nozzle plate has a length that exceeds that of the heater chip, wires coupling traces on the flexible circuit to bond pads on the heater chip must extend through windows or openings provided in the nozzle plate. If, however, the nozzle plate does not extend beyond the bond pads on the heater chip, the wires coupling the traces to the bond pads do not have to extend through windows formed in the nozzle plate. Consequently, the flexible circuit can extend very close to the bond pads on the heater chip and the wires can be made shorter. The shorter wire length is advantageous as it results in more reliable bonds, a lower likelihood of contact between adjacent wires, lower wire loop height, and lower encapsulant bead height. Bead height is important as the distance between the printhead and the paper needs to be at a minimum to ensure optimum dot placement accuracy and to prevent the encapsulant bead from touching cockled paper. Further, nozzle plate manufacture is simplified as wire-receiving windows do not have to be formed in the nozzle plate.

DETAILED DESCRIPTION OF PREFERRED EMBODIMENTS

Figure 1:
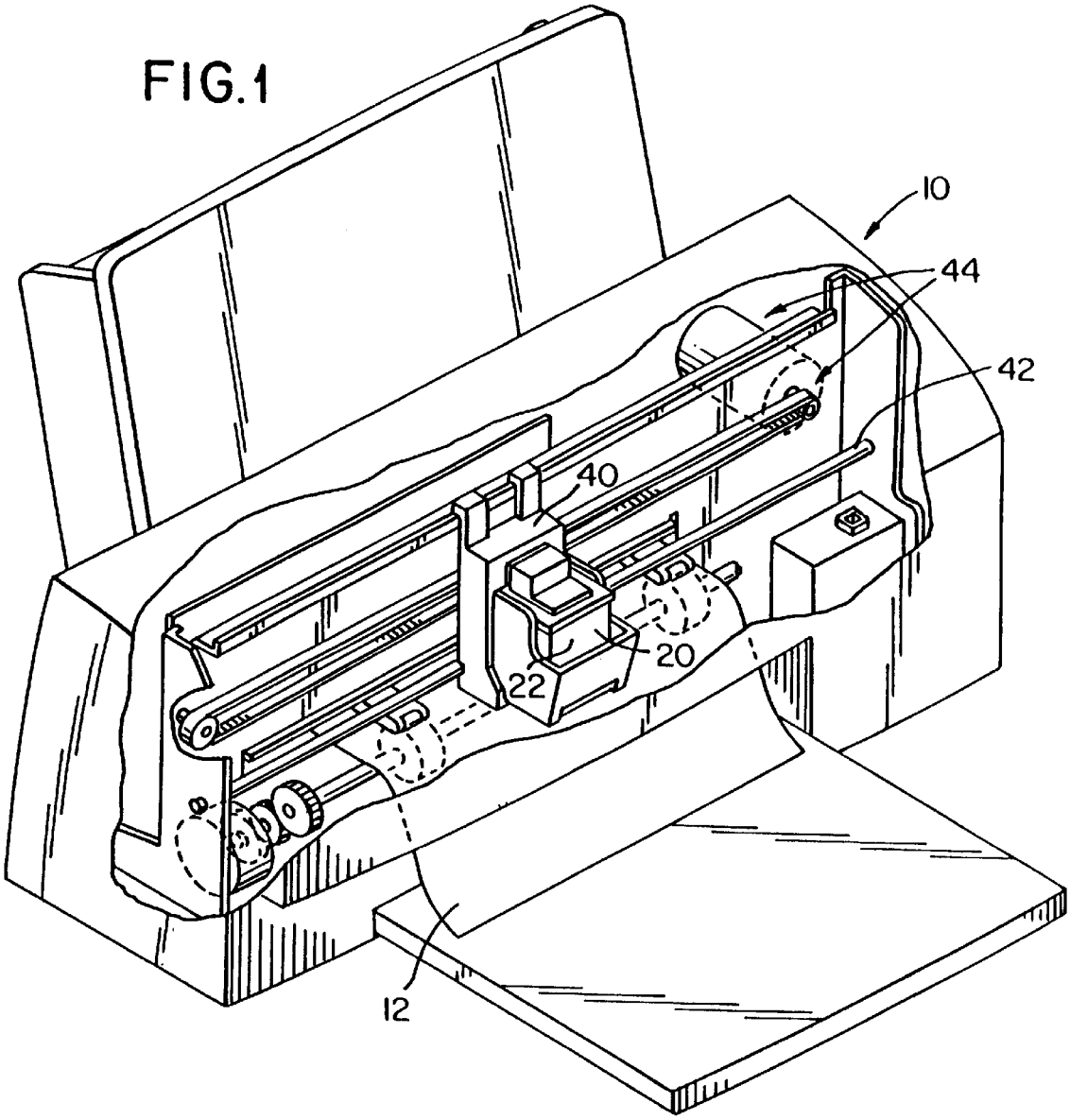
FIG. 1 is a perspective view, partially broken away, of an ink jet printing apparatus having a print cartridge constructed in accordance with the present invention.

Referring now to FIG. 1, there is shown an ink jet printing apparatus 10 having a print cartridge 20 constructed in accordance with the present invention. The cartridge 20 is supported in a carriage 40 which, in turn, is slidably supported on a guide rail 42. A drive mechanism 44 is provided for effecting reciprocating movement of the carriage 40 and the print cartridge 20 back and forth along the guide rail 42. As the print cartridge 20 moves back and forth, it ejects ink droplets onto a paper substrate 12 provided below it.

The print cartridge 20 comprises a container 22, shown only in FIG. 1, filled with ink and a heater chip module 50. The container 22 may be formed from a polymeric material. In the illustrated embodiment, the container 22 is formed from polyphenylene oxide, which is commercially available from the General Electric Company under the trademark "NORYL SE-1." The container 22 may be formed from other materials not explicitly set out herein.

In the embodiment illustrated in FIGS. 2, 2A, 2B, 3, 4A and 4B, the module 50 comprises a carrier 52, an edge-feed heater chip 60 and a nozzle plate 70. The heater chip 60 includes a plurality of resistive heating elements 62 which are located on a base 64, see FIG. 2B. In the illustrated embodiment, the base 64 is formed from silicon. The nozzle plate 70 has a plurality of openings 72 extending through it which define a plurality of nozzles 74 through which ink droplets are ejected. The carrier 52 is secured directly to a bottom side (not shown) of the container 22, i.e., the side in FIG. 1 closest to the paper substrate 12, such as by an adhesive (not shown). In the illustrated embodiment, there is no additional element positioned between the carrier 52 and the container 22. An example adhesive which may be used for securing the carrier 52 directly to the container 22 is one which is commercially available from Emerson and Cuming Specialty Polymers, a division of National Starch and Chemical Company, under the product designation "ECCO-BOND 3193-17."

The nozzle plate 70 may be formed from a flexible polymeric material substrate which is adhered to the heater chip 60 via an adhesive (not shown). Examples of polymeric materials from which the nozzle plate 70 may be formed and adhesives for securing the plate 70 to the heater chip 60 are set out in commonly assigned patent applications, U.S. Ser. No. 08/966,281, entitled "METHOD OF FORMING AN INKJET PRINTHEAD NOZZLE STRUCTURE," by Ashok Murthy et al., filed on Nov. 7, 1997, and U.S. Ser. No. 08/519,906, entitled "METHOD OF FORMING AN INKJET PRINTHEAD NOZZLE STRUCTURE," by Tonya H. Jackson et al., filed on Aug. 28, 1995, the disclosures of which are hereby incorporated by reference. As noted therein, the plate 70 may be formed from a polymeric material such as polyimide, polyester, fluorocarbon polymer, or polycarbonate, which is preferably about 15 to about 200 microns thick, and most preferably about 20 to about 80 microns thick. Examples of commercially available nozzle plate materials include a polyimide material available from E.I. DuPont de Nemours & Co. under the trademark "KAPTON" and a polyimide material available from Ube (of Japan) under the trademark "UPILEX." The adhesive for securing the plate 70 to the heater chip 60 may comprise a phenolic butyral adhesive. A polyimide substrate/phenolic butyral adhesive composite material is commercially available from Rogers Corporation, Chandler, Ariz., under the product name "RFLEX 1100."

The nozzle plate 70 may be bonded to the chip 60 via any art recognized technique, including a thermocompression bonding process. When the plate 70 and the heater chip 60 are joined together, sections 76 of the plate 70 and portions 66 of the heater chip 60 define a plurality of bubble chambers 65, see FIG. 2B. Ink supplied by the container 22 flows into the bubble chambers 65 through ink supply channels 65*a*. As is illustrated in FIG. 2B, the supply channels 65*a* extend from the bubble chambers 65 beyond first and second outer edges 60*a* and 60*b* of the heater chip 60. The resistive heating elements 62 are positioned on the heater chip 60 such that each bubble chamber 65 has only one heating element 62. Each bubble chamber 65 communicates with one nozzle 74.

The carrier 52 includes first, second, third and fourth C-shaped inner side walls 54*a*–54*d* and a support section 56. The inner walls 54*a*–54*d* and the support section 56 define an inner cavity 58. The inner cavity 58 has a first section 58*a* having a first width $W_1$, a second section 58*b* having a second width $W_2$ and a third section 58*c* having a third width $W_3$. The second and third widths $W_2$ and $W_3$ have dimensions which are less than the dimension of the first width $W_1$, see FIG. 2. The first and second inner side walls 54*a* and 54*b* of the carrier 52 and a first portion 56*a* of the support section 56 define the inner cavity first section 58*a*, the third inner side wall 54*c* of the carrier 52 and a second portion 56*b* of the support section 56 define the inner cavity second section 58*b*, and the fourth inner side wall 54*d* of the carrier 52 and a third portion 56*c* of the support section 56 define the inner cavity third section 58*c*.

The carrier 52 comprises a support substrate 54 and a spacer 55, see FIGS. 2, 2B, 3, 4A and 4B. In the illustrated embodiment, the support substrate 54 is formed from silicon. It is also contemplated that the support substrate 54 may be formed from a material selected from the group consisting of ceramics, metals and polymers. The spacer 55 may be formed from a material selected from the group consisting of ceramics, metals, silicon and polymers. The spacer 55 is secured to the support substrate 54 via an adhesive. A more detailed discussion of the carrier 52, the spacer 55 and the adhesive is set out in contemporaneously filed patent application U.S. Ser. No. 09/100,544, entitled "AN INK JET HEATER CHIP MODULE," which has previously been incorporated by reference herein. It is also contemplated that the carrier 52 may comprise a single layer substrate, such as described in contemporaneously filed patent application U.S. Ser. No. 09/100,485, entitled "A HEATER CHIP MODULE AND PROCESS FOR MAKING SAME," which has previously been incorporated by reference herein.

The heater chip 60 is adhesively coupled to the carrier support section 56. As noted above, the nozzle plate 70 is adhesively coupled to the heater chip 60. The nozzle plate 70 has a width such that the plate 70 extends over a first portion 52*a* of an outer surface 52*b* of the carrier 52. The first portion 52*a* includes first and second protruding walls 53 upon which the nozzle plate 70 is positioned so that at least portions of an upper surface of the nozzle plate 70 are generally coplanar with an upper surface of a flexible circuit 90 to be discussed below. In the illustrated embodiment, the heater chip 60 has a length $L_1$ and the nozzle plate has length $L_2$ which is slightly less than length $L_1$ such that the nozzle plate 70 does not cover bond pads 68 on the heater chip 60. While the nozzle plate 70 may extend beyond the length of the heater chip 60, it is preferred that the nozzle plate 70 be substantially equal in length or shorter than the heater chip 60 so that the plate 70 does not cover the bond pads 68 on the heater chip 60.

The heater chip 60 includes first, second, third and fourth side walls 60*c*–60*f*. The support section 56 includes first and second passages 56*e* and 56*f* which define first and second paths for ink to travel from the container 22 to the inner cavity 58. The inner cavity 58 and the heater chip 60 are sized such that the first side wall 60*c* of the heater chip 60 is spaced from the first inner side wall 54*a* of the carrier 52 and a second side wall 60*d* of the heater chip 60 is spaced from a second inner side wall 54*b* of the carrier 52, see FIG. 2B.

The resistive heating elements 62 are individually addressed by voltage pulses provided by a printer energy supply circuit (not shown). Each voltage pulse is applied to one of the heating elements 62 to momentarily vaporize the ink in contact with that heating element 62 to form a bubble within the bubble chamber 65 in which the heating element 62 is located. The function of the bubble is to displace ink within the bubble chamber 65 such that a droplet of ink is expelled from a nozzle 74 associated with the bubble chamber 65.

The flexible circuit 90 is secured to the polymeric container 22 and the carrier 52. It is used to provide a path for energy pulses to travel from the printer energy supply circuit to the heater chip 60. As shown in FIG. 2A, the flexible circuit 90 comprises first and second outer substrate layers 90*a* and 90*b* formed from a polymeric material such as a polyimide or polyester material, first and second inner adhesive layers 90*c* and 90*d* comprising, for example, an acrylic, polyester, phenolic or epoxy adhesive material, and metal traces 90*e*, copper in the illustrated embodiment, positioned between the adhesive and polymeric layers. A process for forming the flexible circuit 90 is discussed in contemporaneously filed patent application entitled "A HEATER CHIP MODULE FOR USE IN AN INK JET PRINTER," which has previously been incorporated by reference herein. The bond pads 68 on the heater chip 60 are wire-bonded to sections 90*f* of the traces 90*e* within the flexible circuit 90 such that a single wire 91 extends from each bond pad 68 through an opening 90*g* in the flexible circuit 90 to a section 90*f* of a metal trace 90*e*, see FIGS. 2 and 2A. Current flows from the printer energy supply circuit to the traces 90*e* within the flexible circuit 90 and from the traces 90*e* to the bond pads 68 on the heater chip 60. Conductors (not shown) are formed on the heater chip base 64 and extend from the bond pads 68 to the heating elements 62. The current flows from the bond pads 68 along the conductors to the heating elements 62. Alternatively, a flexible circuit having traces which are TAB bonded to bond pads on a heater chip, such as described in copending patent application U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," filed Mar. 27, 1997, the disclosure of which is incorporated herein by reference, may be used in place of the circuit 90 described above.

A first gap $G_1$ exists between the carrier third side wall 54*c*, the first side wall 60*c* of the heater chip 60, and portions of the nozzle plate 70 and the support section 56, a second gap $G_2$ exists between the carrier third side wall 54*c*, the second side wall 60*d* of the heater chip 60, and portions of the nozzle plate 70 and the support section 56, a third gap $G_3$ exists between the carrier fourth side wall 54*d*, the first side wall 60*c* of the heater chip 60 and portions of the nozzle plate 70 and the support section 56, and a fourth gap $G_4$ exists between the carrier fourth side wall 54*d*, the second side wall 60*d* of the heater chip 60 and portions of the nozzle plate 70 and the support section 56.

A first sealant material 80 is injected into or otherwise added to the second and third sections 58*b* and 58*c* of the inner cavity 58 after wire bonding has been effected. The sealant material 80 may comprise a thermally curable polymeric material such as an epoxy, examples of which are commercially available from Emerson and Cuming Specialty Polymers, a division of National Starch and Chemical Company under the product designations "ECCOBOND 3193-17" and "Uniset 3032-78." Another material which may be used as the sealant material 80 is a cyanate ester based material such as one which is commercially available from Bryte Technologies Inc. under the product designation "G0063." The material 80 is applied such that it substantially fills the second and third sections 58*b* and 58*c* of the inner cavity 58 behind the third and fourth walls 60*e* and 60*f* of the heater chip 60. The sealant material 80 also extends over the flexible circuit 90 so as to fill the opening 90*g* in the flexible circuit 90 and cover the trace sections 90*f* in the opening 90*g*. The sealant material 80 further abuts or slightly overlaps portions of an outer edge 70*a* of the nozzle plate 70, and covers the bond pads 68 on the heater chip 60 and the wires 91. The sealant material 80 encases or seals the bond pads 68, the trace sections 90*f* and the wires 91 such that ink is prevented from reaching those elements. The sealant material 80 also flows, via capillary action, into the gaps $G_1$, $G_2$, $G_3$ and $G_4$ so as to seal the gaps and prevent ink from passing through the gaps.

The first inner side wall 54*a* of the carrier 52, a portion of the first side wall 60*c* of the heater chip 60, a first section 70*b* of the nozzle plate 70, a part 57*a* of the support section 56, and the sealant material 80 provided in the gaps $G_1$ and $G_3$ define a first sealed ink cavity 95 for receiving ink passing through the first passage 56*e*. The second inner side wall 54*b* of the carrier 52, a portion of the second side wall 60*d* of the heater chip 60, a second section 70*c* of the nozzle plate 70, a part 57*b* of the support section 56, and the sealant material 80 provided in the gaps $G_2$ and $G_4$ define a second sealed ink cavity 97 for receiving ink passing through the second passage 56*f*.

If the nozzle plate extends beyond the bond pads on the heater chip, the nozzle plate needs to include openings for receiving the wires coupling the trace sections 91*f* to the bond pads 68. In such a case, the openings 90*g* in the flexible circuit 90 must be spaced a sufficient distance away from the bond pads 68 so as to permit the wires 91 to have a sufficiently large loop height such that the wires 91 are able to pass through the openings in the nozzle plate 90 down to the bond pads 68. Because the nozzle plate 70, in the illustrated embodiment, does not extend over or completely cover the bond pads 68 on the heater chip 60, the flexible circuit 90 can extend very close to the bond pads 68 and the wires 91 can be made shorter. The shorter wire length is advantageous as it results in higher reliability bonds, a lower likelihood of contact between adjacent wires 91, a lower wire loop height, and a lower sealant material bead height. "Sealant material bead height" is the height of the sealant material 80 located in the second and third sections 58*b* and 58*c* of the inner cavity 58 and over the nozzle plate 70 and the flexible circuit 90. It may be measured, for example, from the outer surface 52*b* of the carrier 52. Bead height is important as the distance between the module 50 and the paper 12 needs to be at a minimum to ensure optimum dot placement accuracy and to prevent the sealant material bead from touching cockled paper. Further, nozzle plate manufacture is simplified as wire-receiving windows do not need to be formed in the nozzle plate 70.

As noted above, the nozzle plate 70 comprises a flexible polymeric material substrate. In the illustrated embodiment, the flexible substrate is provided with an overlaid layer of phenolic butyral adhesive for securing the nozzle plate 70 to the heater chip 60.

Initially, the nozzle plate 70 is aligned with and mounted to the heater chip 60. At this point, the heater chip 60 has been separated from other heater chips 60 formed on the same wafer. Alignment may take place as follows. One or more first fiducials (not shown) may be provided on the nozzle plate 70 which are aligned with one or more second fiducials (not shown) provided on the heater chip 60. After the nozzle plate 70 is aligned to and located on the heater chip 60, the plate 70 is tacked to the heater chip 60 using, for example, a conventional thermocompression bonding process. The phenolic butyral adhesive on the nozzle plate 70 is not fully cured after the tacking step has been completed.

An adhesive material (not shown), such as a 0.002 inch die-cut phenolic adhesive film, which is commercially available from Rogers Corporation (Chandler, Ariz.) under the product designation "1000B200," is placed on a second portion 52*c* of the outer surface 52*b* of the carrier 52 to which the flexible circuit 90 is to be secured. At this juncture, the spacer 56 has been bonded to the support substrate 54. Thereafter, the flexible circuit 90 is positioned over the adhesive film and tacked to the carrier 52 using heat and pressure.

The nozzle plate/heater chip assembly is then aligned with and tacked to the carrier 52 such as in the manner described in the above referenced patent application entitled "AN INK JET HEATER CHIP MODULE." The heater chip module 50 is then heated in an oven for a time period sufficient to effect the curing of the following materials: the phenolic butyral adhesive that bonds the nozzle plate 70 to the heater chip 60 and the carrier 52; the phenolic adhesive film which joins the flexible circuit 90 to the carrier 52; and a die bond adhesive (not shown) which joins the heater chip 60 to the carrier 52.

Figure 2:
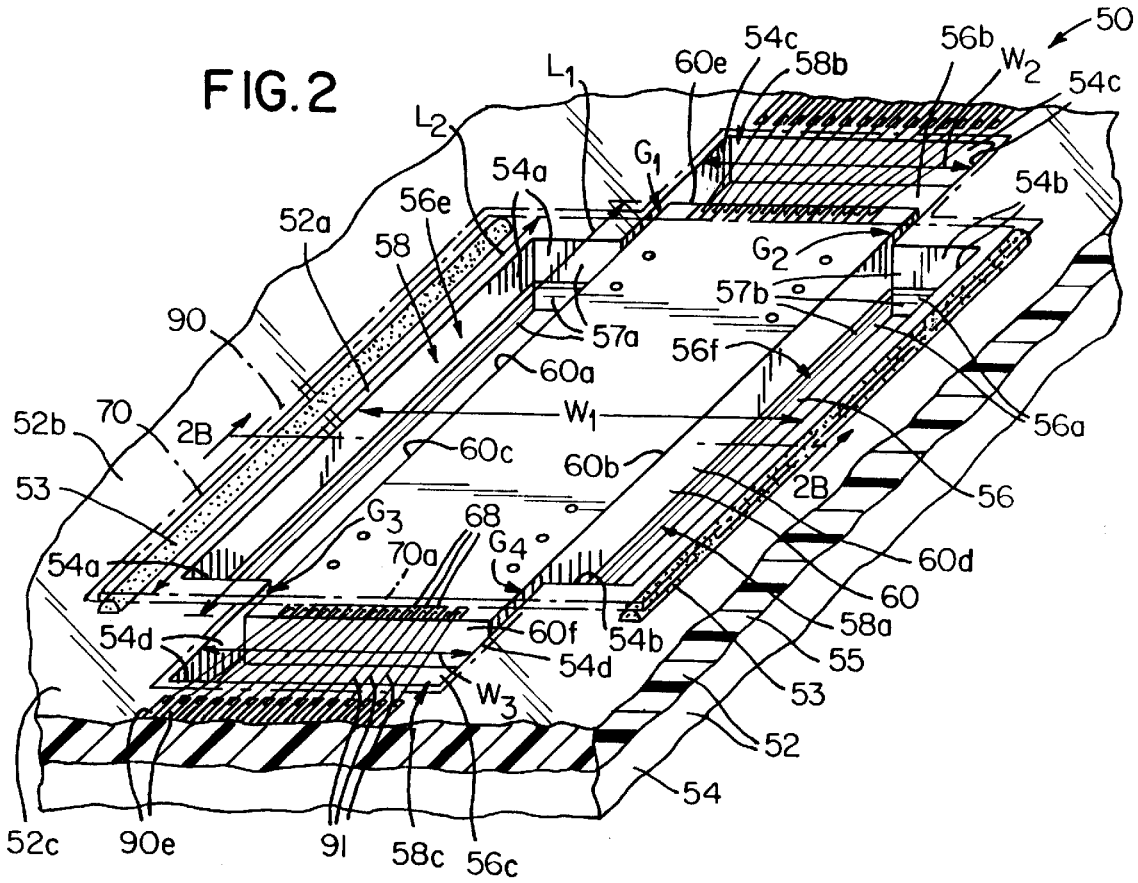
FIG. 2 is a perspective view, partially in cross section, of a portion of a heater chip module constructed in accordance with a first embodiment of the present invention.
Figure 3:
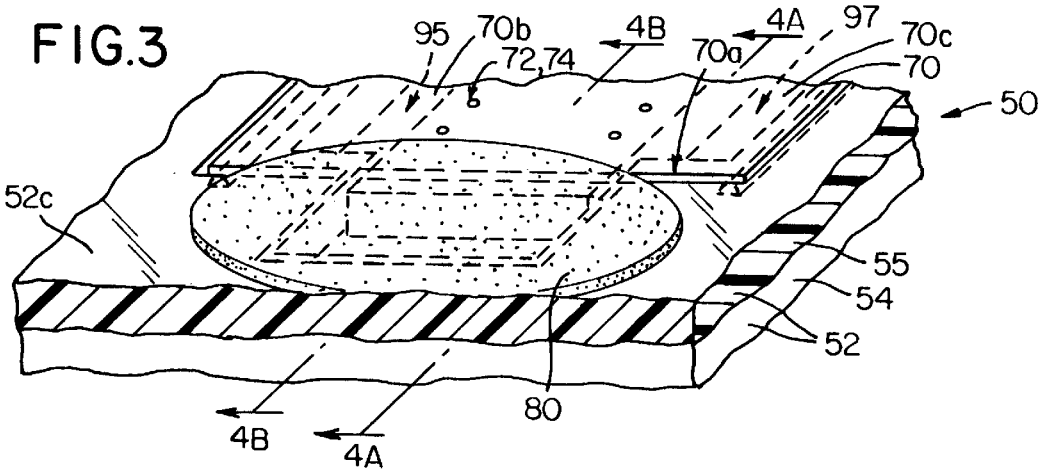
FIG. 3 is a perspective view, partially in cross section, of a portion of the heater chip module illustrated in FIG. 2.
Figure 4A:
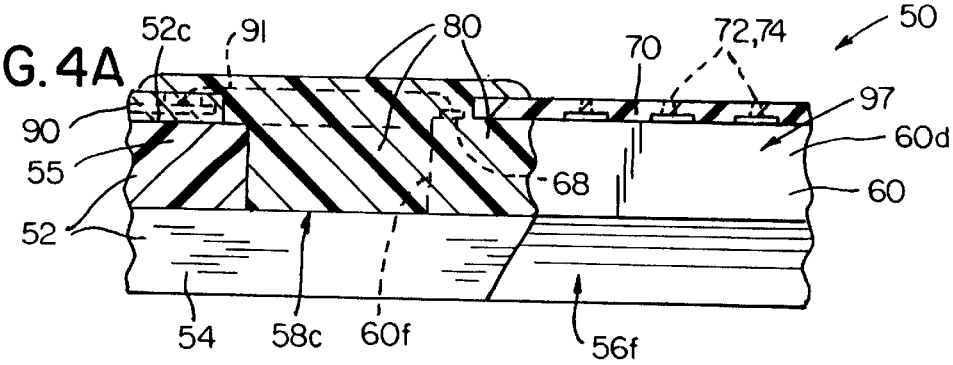
FIG. 4A is a view taken along section line 4A—4A in FIG. 3.
Figure 4B:
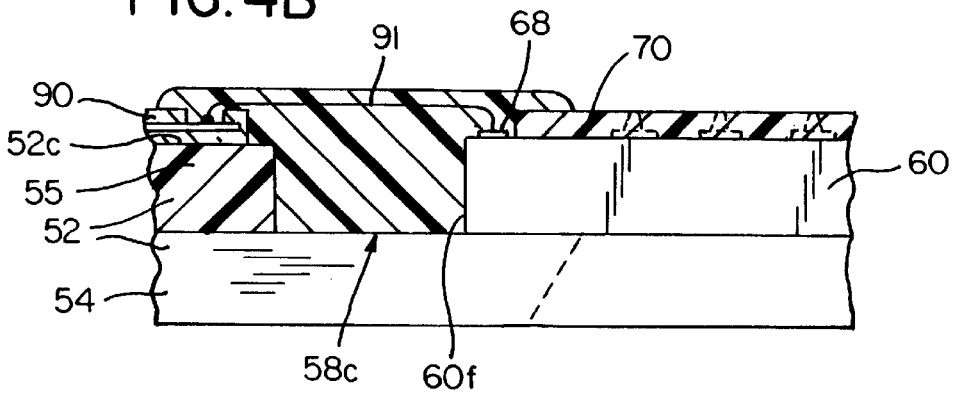
FIG. 4B is a view taken along section line 4B—4B in FIG. 3.
Figure 2A:
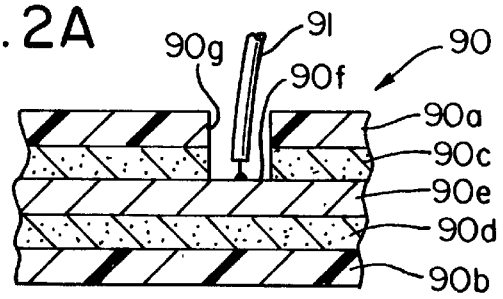
FIG. 2A is a cross sectional view of a portion of a flexible circuit of the module illustrated in FIG. 2.
Figure 2B:
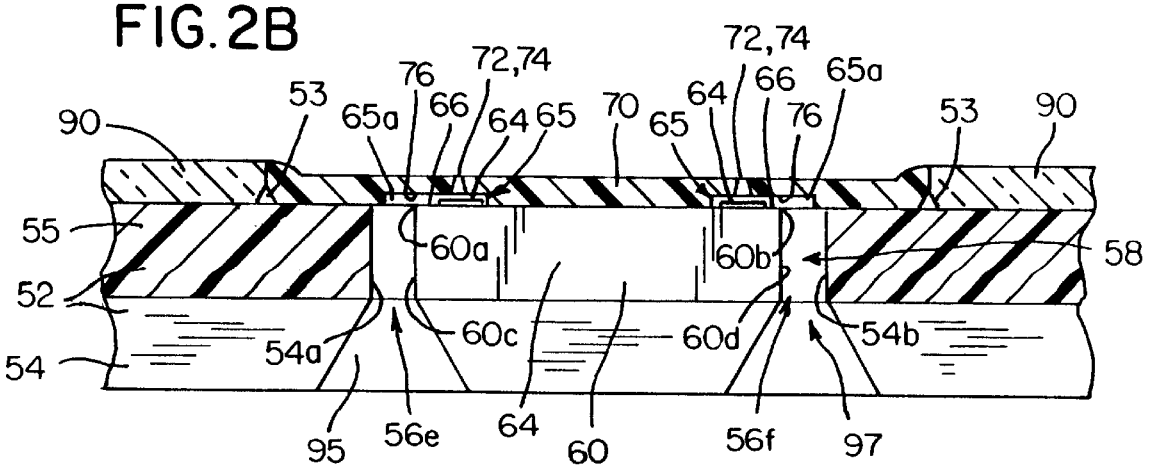
FIG. 2B is a view taken along section line 2B—2B in FIG. 2.

After the nozzle plate/heater chip assembly and the flexible circuit 90 have been bonded to the carrier 52, the bond pads 68 on the heater chip 60 are wire-bonded to sections 90*f* of the traces 90*e* within the flexible circuit 90, see FIGS. 2 and 2A. A single wire 91 extends from each bond pad/trace pair after wire-bonding has been effected. After wire-bonding, the sealant material 80 is added to the second and third sections 58*b* and 58*c* of the inner cavity 58 and over a portion of the flexible circuit 90 and the nozzle plate 70. The module 50 is then heated in an oven at a temperature and for a time period sufficient to effect the curing of the sealant material 80.

The heater chip module 50, which comprises the nozzle plate/heater chip assembly and the carrier 52, and to which the flexible circuit 90 is coupled, is aligned with and bonded directly to a polymeric container 22. An adhesive (not shown) such as one which is commercially available from Emerson and Cuming Specialty Polymers, a division of National Starch and Chemical Company under the product designation "ECCOBOND 3193-17" is applied to a portion of the container where the module 50 is to be located. The module 50 is then mounted to the container portion. Thereafter, the heater chip module 50 and the container 22 are heated in an oven at a temperature and for a time period sufficient to effect the curing of the adhesive.

A portion of the flexible circuit 90 which is not joined to the carrier 52 is bonded to the container 22 by, for example, a conventional free-standing pressure sensitive adhesive film, such as described in the above referenced patent application entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL."

Figure 5:
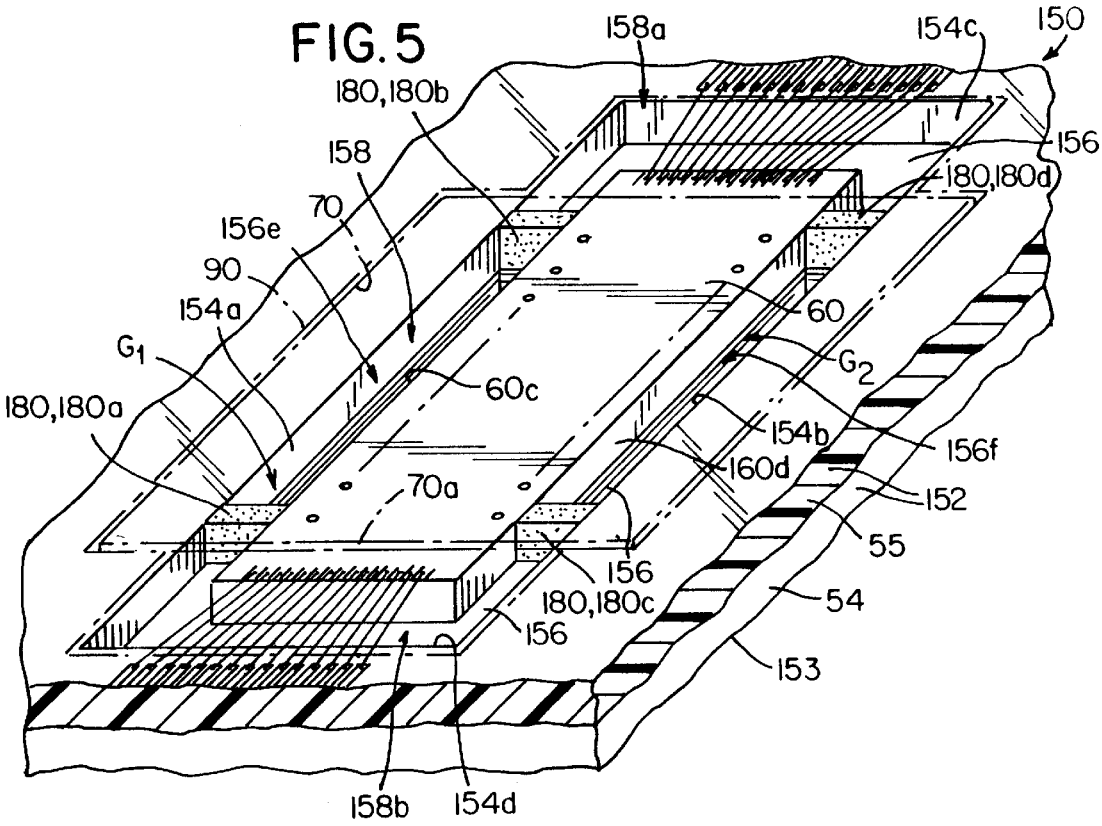
FIG. 5 is a perspective view, partially in cross section, of a portion of a heater chip module constructed in accordance with a second embodiment of the present invention.
Figure 6:
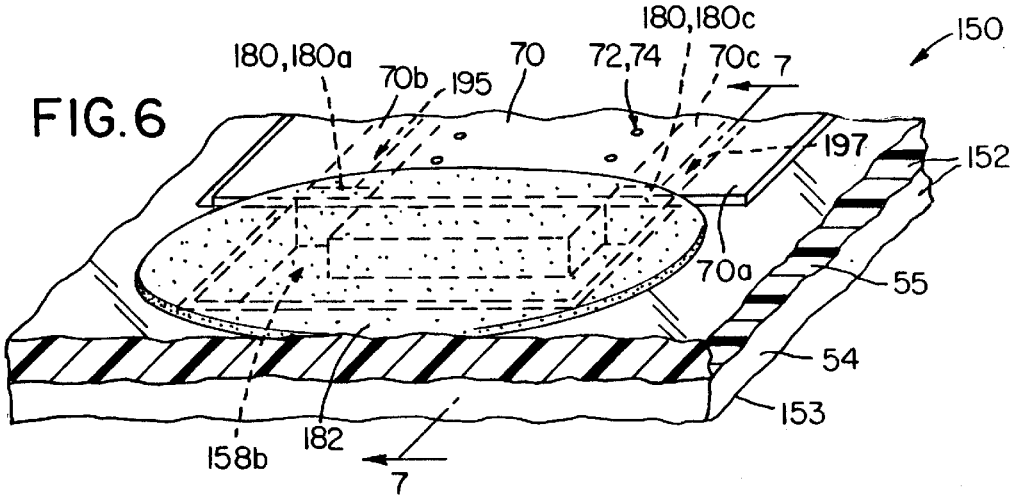
FIG. 6 is a perspective view, partially in cross section, of a portion of the heater chip module illustrated in FIG. 5.
Figure 7:
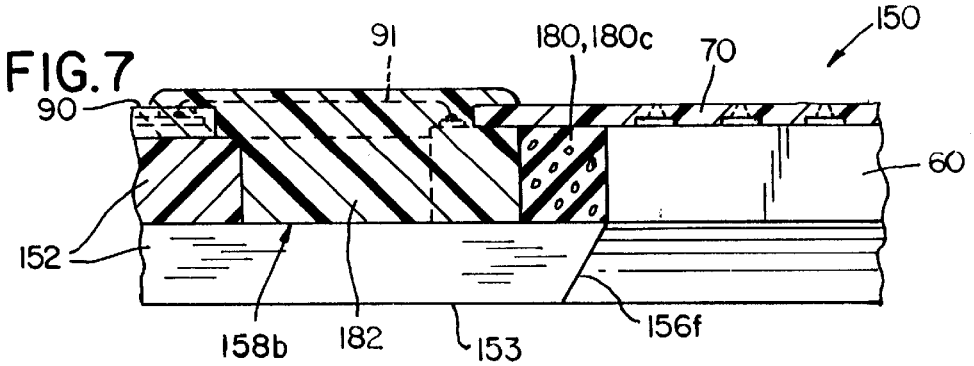
FIG. 7 is a view taken along section line 7—7 in FIG. 6

A heater chip module 150, formed in accordance with a second embodiment of the present invention, is shown in FIGS. 5–7, wherein like reference numerals indicate like elements. Here, the carrier 152 includes an inner cavity 158 having a generally rectangular shape. The carrier 152 further includes first, second, third and fourth inner side walls 154*a*–154*d* and a support section 156 to which the edge-feed heater chip 60 is coupled. A first gap $G_1$ exists between the carrier first side wall 154*a* and the first side wall 60*c* of the heater chip 60 and a second gap $G_2$ exists between the carrier second side wall 154*b* and the second side wall 60*d* of the heater chip 60.

After the nozzle plate 70 has been bonded to both the heater chip 60 and the carrier 152, and the nozzle plate/heater chip assembly and the flexible circuit 90 have been bonded to the carrier 152, a first sealant material 180 comprising a commercially available ink resistant foam material is injected into the inner cavity 158 at locations in the gaps $G_1$ and $G_2$ beneath portions of the outer edge 70*a* of the nozzle plate 70. The sealant material 180 may be injected from the backside 153 of the carrier 152 through passages 156*e* and 156*f* which extend completely through the carrier 152. It is also contemplated that the sealant material 180 may be injected from the side opposite to the backside 153. The first sealant material 180, after it cures, defines first and second dams 180*a* and 180*b* within the first gap $G_1$ and third and fourth dams 180*c* and 180*d* within the second gap $G_2$. Thus, a portion of the first inner side wall 154*a* of the carrier 152, a portion of the first side wall 60*c* of the heater chip 60, a first section 70*b* of the nozzle plate 70 and the first and second sealant material dams 180*a* and 180*b* define a first sealed ink cavity 195 for receiving ink passing through the first carrier passage 156*e*. Further, a portion of the second inner side wall 154*b* of the carrier 152, a portion of the second side wall 60*d* of the heater chip 60, a second section 70*c* of the nozzle plate 70 and the third and fourth sealant material dams 180*c* and 180*d* define a second sealed ink cavity 197 for receiving ink passing through the second carrier passage 156*f*.

Wire bonding is then effected. Thereafter, a second sealant material 182 is injected into or otherwise provided to first and second end sections 158*a* and 158*b* of the inner cavity 158 behind the first, second, third and fourth dams 180*a*–180*d*. The sealant material 182 may comprise a thermally curable polymeric material, examples of which are commercially available from Emerson and Cuming Specialty Polymers, a division of National Starch and Chemical Company under the product designations "ECCOBOND 3193-17" and "Uniset 3032-78." Another material which may be used as the sealant material 182 is a cyanate ester based material, such as one which is commercially available from Bryte Technologies under the product designation "G0063." The material 182 is applied such that it substantially fills the first and second end sections 158*a* and 158*b* of the inner cavity 158 behind the dams 180*a*–180*d*. The sealant material 182 also extends over the flexible circuit 90 and abuts or slightly overlaps portions of the outer edge 70*a* of the nozzle plate 70. The sealant material 182 covers the trace sections 90*f* in the opening 90*g* in the flexible circuit 90, the bond pads 68 on the heater chip 60 and the wires 91.

It is also contemplated that preformed polymeric elements having a generally square or rectangular shape, e.g., rubber square inserts, may be used in place of the foam dams 180*a*–180*d* described above. The rubber inserts are tacked in place within the inner cavity 152 in the same locations where the dams 180*a*–180*d* are provided, see FIG. 5, prior to the nozzle plate/heater chip assembly being joined to the carrier 152. A conventional ultraviolet (UV) curable adhesive (not shown), such as one which is commercially available from Emerson and Cuming Specialty Polymers, a division of National Starch and Chemical Company under the product designation "Uniset UV9000" may be used to tack the inserts in place. Gaps existing between the rubber inserts, the first and second inner side walls 154*a* and 154*b* of the carrier 152 and the first and second side walls 60*c* and 60*d* of the heater chip 160 are filled with the second sealant material 182 in the same manner that the sealant material 80 seals gaps $G_1$, $G_2$, $G_3$ and $G_4$ in the FIG. 2 embodiment.

Figure 8:
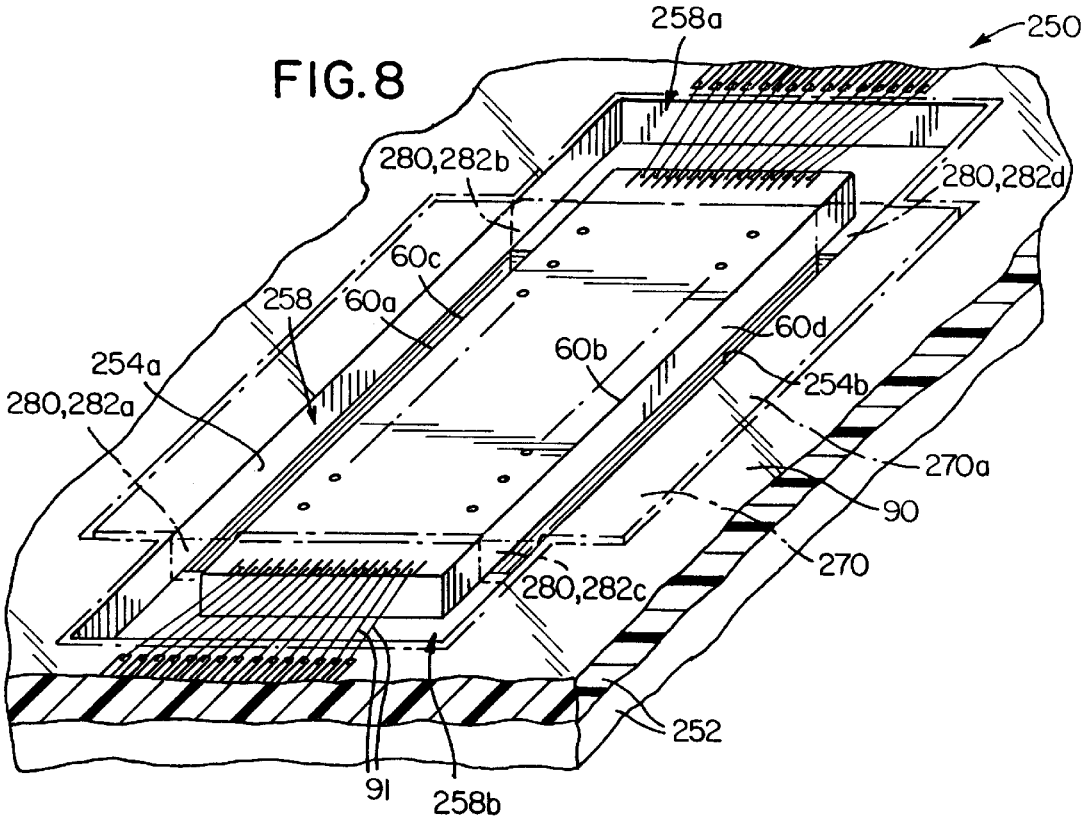
FIG. 8 is a perspective view, partially in cross section, of a portion of a heater chip module constructed in accordance with a third embodiment of the present invention.
Figure 9:
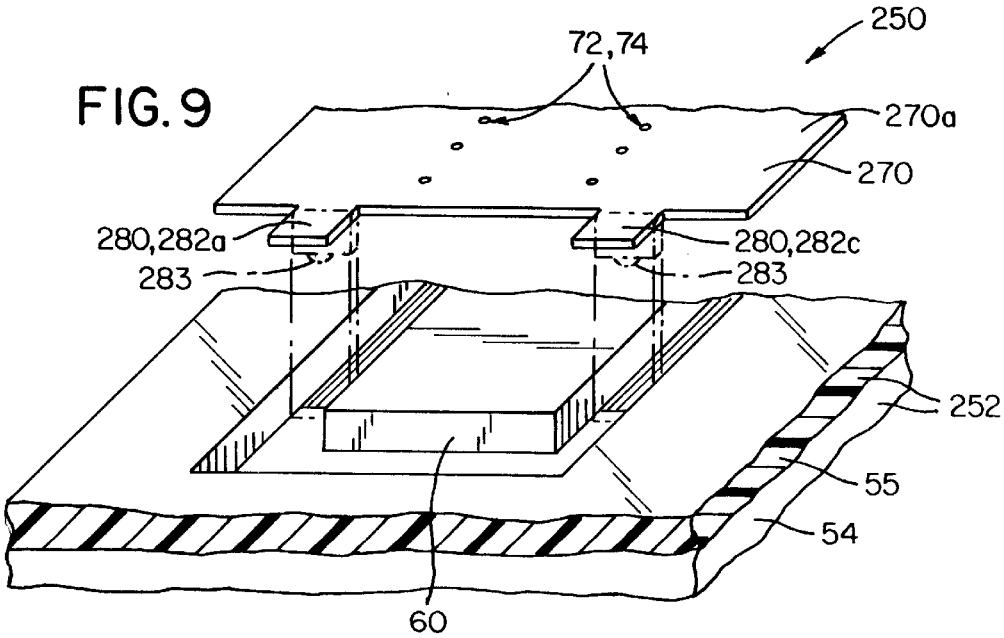
FIG. 9 is an exploded, perspective view, partially in cross section, of a portion of the heater chip module illustrated in FIG. 8.
Figure 10:
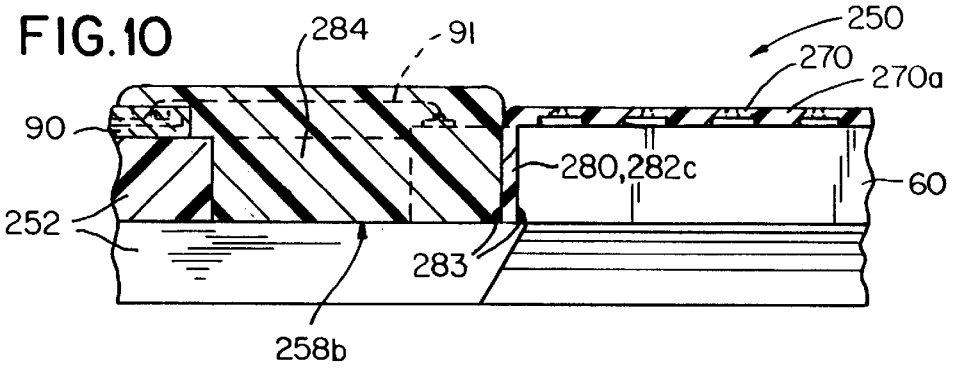
FIG. 10 is a cross-sectional view of a portion of the heater chip module illustrated in FIG. 8.

A heater chip module 250, formed in accordance with a third embodiment of the present invention, is shown in FIGS. 8–10, wherein like reference numerals indicate like elements. Here, the first sealant material 280 comprises first, second, third and fourth nozzle plate tab portions 282*a*–282*b*. The tab portions 282*a*–282*b* are integral with a main portion 270*a* of the nozzle plate 270 and are bent about 90 degrees relative to the main portion 270*a*. Prior to the nozzle plate/heater chip assembly being joined to the carrier 252, a conventional ultraviolet (UV) curable adhesive 283, such as one which is commercially available from Emerson and Cuming Specialty Polymers, a division of National Starch and Chemical Company under the product designation "Uniset UV9000," is provided at four locations on the carrier 252 where the tab portions 282*a*–282*b* are to contact or nearly contact the carrier 252. The nozzle plate/heater chip assembly is then mounted to the carrier 252. Just before or after the nozzle plate/heater chip assembly is mounted to the carrier 252, the tab portions 282*a*–282*b* are folded down so as to be positioned in a generally vertical plane and contact the UV adhesive previously applied to the carrier 252. The UV adhesive is then cured using ultraviolet radiation. The UV adhesive tacks the tab portions 282*a*–282*b* in place. A second sealant material 284, which is the same material as the second sealant material 182 described above with regard to the FIG. 5 embodiment, is injected into or otherwise provided to first and second end sections 258*a* and 258*b* of the inner cavity 258 behind the tab portions 282*a*–282*b*, see FIG. 10. Gaps existing between the tab portions 282*a*–282*b*, the first and second inner side walls 254*a* and 254*b* of the carrier 252 and the first and second walls 60*c* and 60*d* of the heater chip 60 are filled by the second sealant material 284 in the same manner that the sealant material 80 seals gaps $G_1$, $G_2$, $G_3$ and $G_4$ in the FIG. 2 embodiment. The second sealant material 284 also permanently secures the tab portions 282*a*–282*b* in their generally vertical positions.

Figure 11:
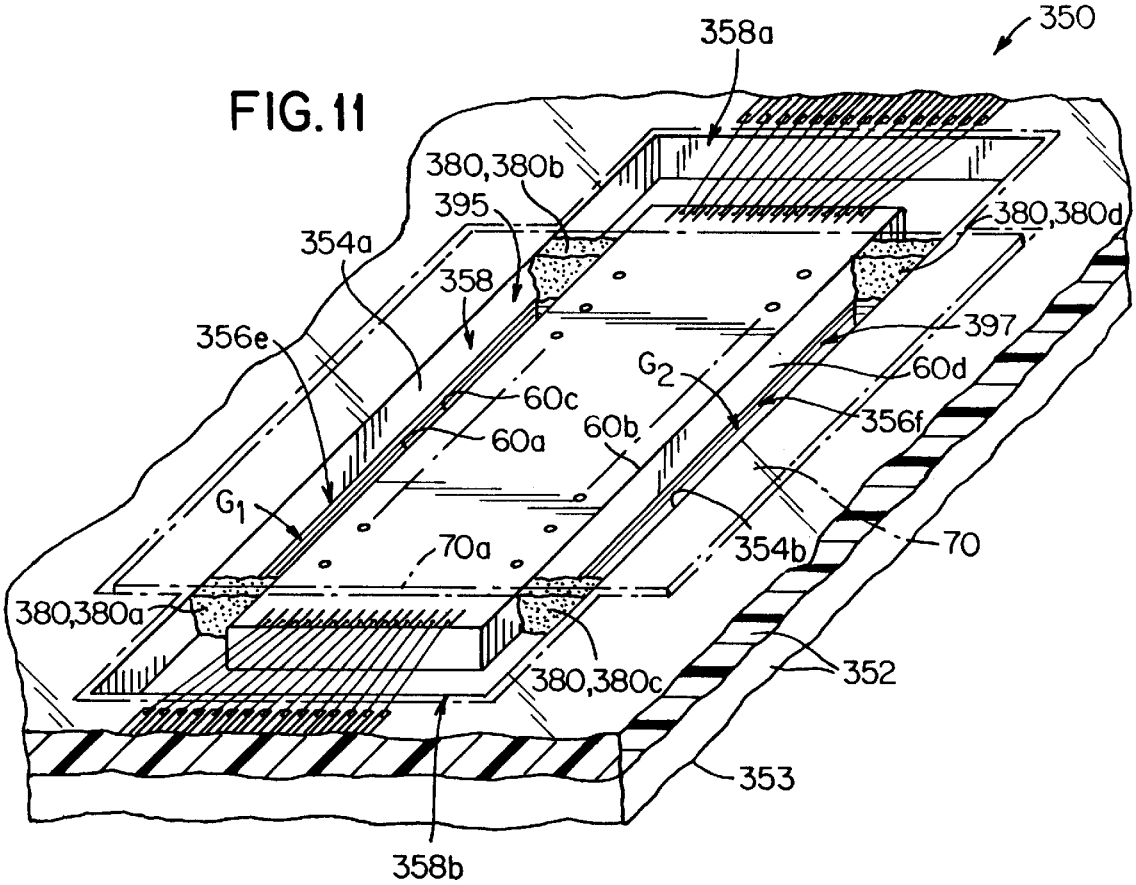
FIG. 11 is a perspective view, partially in cross section, of a portion of a heater chip module constructed in accordance with a fourth embodiment of the present invention.
Figure 12:
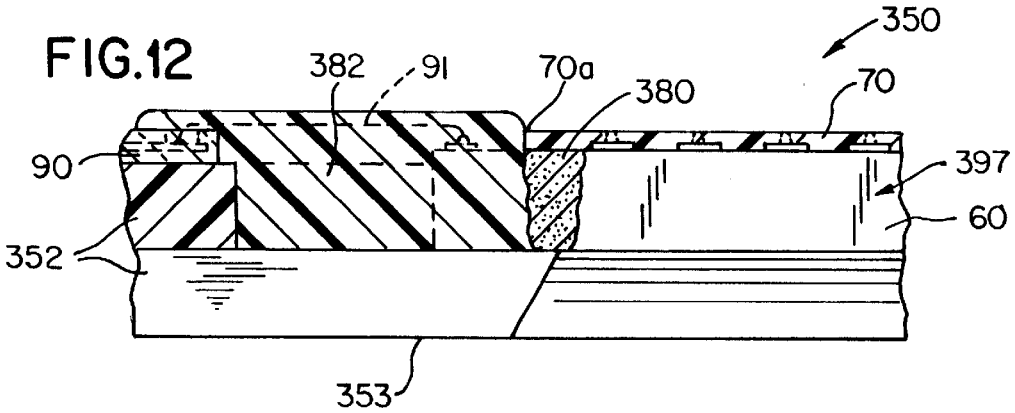
FIG. 12 is a cross-sectional view of a portion of the heater chip module illustrated in FIG. 11.

A heater chip module 350, formed in accordance with a fourth embodiment of the present invention, is shown in FIGS. 11 and 12, wherein like reference numerals indicate like elements. After the nozzle plate 70 has been bonded to both the heater chip 60 and the carrier 352 and the nozzle plate/heater chip assembly and the flexible circuit 90 have been bonded to the carrier 352, a first sealant material 380 comprising a commercially available ultraviolet (UV) curable adhesive, such as one which is commercially available from Emerson and Cuming Specialty Polymers, a division of National Starch and Chemical Company under the product designation "Uniset UV9000," is injected or otherwise inserted into inner cavity 358 at locations in gaps $G_1$ and $G_2$ beneath outer portions of the nozzle plate 70. Preferably, the sealant material 380 is injected from the backside 353 of the carrier 352 through passages 356*e* and 356*f* which extend completely through the carrier 352. The sealant material 380 is then cured using ultraviolet radiation. The first sealant material 380, after it cures, defines first and second dams 380*a* and 380*b* within the first gap $G_1$ and third and fourth dams 380*c* and 380*d* within the second gap $G_2$. Thus, a portion of the first inner side wall 354*a* of the carrier 352, a portion of the first side wall 60*c* of the heater chip 60, a first section of the nozzle plate 70 and the first and second sealant material dams 380*a* and 380*b* define a first sealed ink cavity 395 for receiving ink passing through the carrier first passage 356*e*. Further, a portion of the second inner side wall 354*b* of the carrier 352, a portion of the second side wall 60*d* of the heater chip 60, a second section of the nozzle plate 70 and the third and fourth sealant material dams 380*c* and 380*d* define a second sealed ink cavity 397 for receiving ink passing through the carrier second passage 356*f*.

Wire bonding is then effected. Thereafter, a second sealant material 382 is injected into or otherwise provided to first and second end sections 358*a* and 358*b* of the inner cavity 358 behind the first, second, third and fourth dams 380*a*–380*d*. The sealant material 382 may comprise a thermally curable polymeric material such as an epoxy, examples of which are commercially available from Emerson and Cuming Specialty Polymers, a division of National Starch and Chemical Company under the product designation "ECCOBOND 3193-17" and Uniset "3032-78." Another material which may be used as the sealant material 382 includes a cyanate ester based material, one of which is commercially available from Bryte Technologies Inc. under the product designation "G0063." The material 382 is applied such that it substantially fills the first and second end sections 358*a* and 358*b* of the inner cavity 358 behind the dams 380*a*–380*d*. The sealant material 382 also extends over the flexible circuit 90 and abuts or slightly overlaps portions of the outer edge 70*a* of the nozzle plate 70. The sealant material 382 covers the trace sections 90*f* in the opening 90*g* in the flexible circuit 90, the bond pads 68 on the heater chip 60 and the wires 91. Gaps existing between the dams 380*a*–380*d*, the first and second inner side walls 354*a* and 354*b* of the carrier 352 and the first and second walls 60*c* and 60*d* of the heater chip 60 are filled by the material 382 in the same manner that the sealant material 80 seals gaps $G_1$, $G_2$, $G_3$ and $G_4$ in the FIG. 2 embodiment.

What is claimed is:

1. A heater chip module comprising:

a carrier adapted to be secured to a container for receiving ink and including inner side walls and a support section which together define an inner cavity;

an edge feed heater chip coupled to said carrier support section, said heater chip including side walls, said support section including a first passage therein which defines a first path for ink to travel from the container to said inner cavity, said inner cavity and said heater chip being sized such that a first side wall of said heater chip is spaced from a first inner side wall of said carrier;

a nozzle plate coupled to said heater chip and said carrier, said nozzle plate having a width such that said nozzle plate extends over an outer surface of said carrier; and sealant material provided in said inner cavity between at least one of said inner side walls of said carrier and said first side wall of said heater chip such that at least a portion of said first inner side wall of said carrier, at least a portion of said first side wall of said heater chip, a first section of said nozzle plate and said sealant material define a first sealed ink cavity for receiving ink passing through said first passage.

2. A heater chip module as set forth in claim 1, wherein said inner cavity has a first length, said heater chip has a second length and said nozzle plate has a third length which is less than said first length and approximately equal to or less than said second length.

3. A heater chip module as set forth in claim 2, wherein said nozzle plate is coupled directly to said heater chip.

4. A heater chip module as set forth in claim 1, wherein said inner cavity has a first section with a first width and second and third sections having second and third widths which are less than said first width, said carrier further including second, third and fourth inner side walls, said first and second inner side walls of said carrier and a first portion of said support section define said inner cavity first section, said carrier third inner side wall and a second portion of said support section define said inner cavity second section, and said carrier fourth inner side wall and a third portion of said support section define said inner cavity third section, said sealant material comprising a polymeric material which is positioned between said carrier third side wall and said first side wall of said heater chip and between said carrier fourth side wall and said first side wall of said heater chip.

5. A heater chip module as set forth in claim 4, wherein said polymeric material comprises a heat curable polymeric material.

6. A heater chip module comprising:

a carrier adapted to be secured to a container for receiving ink and including inner side walls and a support section which together define an inner cavity;

an edge feed heater chip coupled to said carrier support section, said heater chip including side walls, said support section including a first passage which defines a first path for ink to travel from the container to said inner cavity, said inner cavity and said heater chip being sized such that a first side wall of said heater chip is spaced from a first inner side wall of said carrier;

a nozzle plate coupled to said heater chip and said carrier, said nozzle plate having a width such that said nozzle plate extends over an outer surface of said carrier; and sealant material provided in said inner cavity such that at least a portion of said first inner side wall of said carrier, at least a portion of said first side wall of said heater chip, a first section of said nozzle plate and said sealant material define a first sealed ink cavity for receiving ink passing through said first passage, said sealant material comprising first and second tab portions extending down from said nozzle plate.

7. A heater chip module as set forth in claim 1, wherein said sealant material comprises a polymeric material.

8. A heater chip module as set forth in claim 7, wherein said polymeric material comprises a foam material.

9. A heater chip module as set forth in claim 7, wherein said polymeric material comprises a rubber.

10. A heater chip module as set forth in claim 1, wherein said sealant material comprises a first polymeric material which provides a dam within said inner cavity and a second polymeric material which seals around said first polymeric material dam.

11. A heater chip module as set forth in claim 1, wherein said carrier comprises a single layer substrate.

12. A heater chip module as set forth in claim 11, wherein said single layer substrate is formed from a material selected from the group consisting of ceramics, metals, silicon and polymers.

13. A heater chip module as set forth in claim 1, wherein said carrier comprises a support substrate and a spacer secured to said support substrate, said spacer having an opening defined by inner side walls which define said inner side walls of said carrier, said support substrate having first and second outer surfaces and a portion which defines said carrier support section, an upper surface of said support substrate portion and said inner side walls of said spacer defining said inner cavity of said carrier.

14. A heater chip module set forth in claim 13, wherein said support substrate is formed from a material selected from the group consisting of ceramics, metals, silicon and polymers.

15. A heater chip module as set forth in claim 14, wherein said spacer is formed from a material selected from the group consisting of ceramics, metals, silicon and polymers.

16. A heater chip module as set forth in claim 1, wherein a first part of said support section defines a portion of said first sealed ink cavity.

17. A heater chip module as set forth in claim 1, wherein said support section further includes a second passage which defines a second path for ink to travel from the container to said inner cavity, and said inner cavity and said heater chip being sized such that a second side wall of said heater chip is spaced from a second inner side wall of said carrier; and further comprising additional sealant material provided within said inner cavity such that at least a portion of said second inner side wall of said carrier, at least a portion of said second side wall of said heater chip, a second section of said nozzle plate and said additional sealant material define a second sealed ink cavity for receiving ink passing through said second passage.

18. A flexible circuit/beater chip module assembly comprising:

a carrier adapted to be secured to a container for receiving ink and including inner side walls and a support section which together define an inner cavity;

an edge feed heater chip coupled to said carrier support section, said heater chip including side walls, said support section including a first passage therein which defines a first path for ink to travel from the container to said inner cavity, said inner cavity and said heater chip being sized such that a first side wall of said beater chip is spaced from a first inner side wall of said carrier;

a nozzle plate coupled to said heater chip and said carrier, said nozzle plate having a width such that said nozzle plate extends over an outer surface of said carrier;

sealant material provided in said inner cavity between at least one of said inner side walls of said carrier and said first side wall of said heater chip and being in contact or integral with said nozzle plate, at least a portion of said first inner side wall of said carrier, at least a portion of said first side wall of said beater chip, a first section of said nozzle plate and said sealant material defining a first sealed ink cavity for receiving ink passing through said first passage; and a flexible circuit coupled to said heater chip.

19. A flexible circuit/heater chip module assembly as set forth in claim 18, wherein said inner cavity has a first length, said heater chip has a second length and said nozzle plate has a third length which is less than said first length.

20. A flexible circuit/heater chip module assembly as set forth in claim 19, wherein said third length is approximately equal to or less than said second length.

21. A flexible circuit/heater chip module assembly as set forth in claim 18, wherein said inner cavity has a first section with a first width and second and third sections having second and third widths which are less than said first width, said carrier further including second, third and fourth inner side walls, said first and second inner side walls of said carrier and a first portion of said support section define said inner cavity first section, said carrier third inner side wall and a second portion of said support section define said inner cavity second section, and said carrier fourth inner side wall and a third portion of said support section define said inner cavity third section, said sealant material comprising a polymeric material which is positioned between said carrier third side wall and said first side wall of said heater chip and between said carrier fourth side wall and said first side wall of said heater chip.

22. A flexible circuit/heater chip module assembly as set forth in claim 18, wherein said sealant material comprises first and second tab portions extending down from said nozzle plate.

23. A flexible circuit/heater chip module assembly as set forth in claim 18, wherein said sealant material comprises a polymeric material.

24. A flexible circuit/heater chip module assembly as set forth in claim 18, wherein said sealant material comprises a first polymeric material which provides a dam within said inner cavity and a second polymeric material which seals around said first polymeric material dam.

25. A flexible circuit/heater chip module assembly as set forth in claim 18, wherein said support section further includes a second passage which defines a second path for ink to travel from the container to said inner cavity, and said inner cavity and said heater chip being sized such that a second side wall of said heater chip is spaced from a second inner side wall of said carrier; and further comprising additional sealant material provided within said inner cavity such that at least a portion of said second inner side wall of said carrier, at least a portion of said second side wall of said heater chip, a second section of said nozzle plate and said additional sealant material define a second sealed ink cavity for receiving ink passing through said second passage.

26. A flexible circuit/heater chip module assembly as set forth in claim 18, wherein said flexible circuit comprises a substrate layer and at least one conductor trace on said substrate layer, said at least one conductor trace having a section which is coupled to a bond pad on said heater chip.

27. A flexible circuit/heater chip module assembly as set forth in claim 26, where said conductor trace section is wire bonded to said bond pad.

28. A flexible circuit/heater chip module assembly as set forth in claim 26, where said conductor trace section is TAB bonded to said bond pad.

29. A heater chip module as set forth in claim 1, wherein said sealant material is either integral with or in contact with said nozzle plate.

30. A heater chip module as set forth in claim 1, wherein said first sealed ink cavity has a length that is greater than one half of the length of said heater chip.

* * * * *